US009550391B2

(12) United States Patent
Rosato et al.

(10) Patent No.: US 9,550,391 B2
(45) Date of Patent: Jan. 24, 2017

(54) RETRACTABLE WRITING INSTRUMENT

(71) Applicant: BIC Corporation, Shelton, CT (US)

(72) Inventors: Steven Rosato, Palm Harbor, FL (US); Christopher K. Nelson, Dunedin, FL (US); Stephen Wegzyn, Lutz, FL (US); Derek Diaz, Lutz, FL (US)

(73) Assignee: BIC CORPORATION, Shelton, CT (US)

( * ) Notice: Subject to any disclaimer, the term of this patent is extended or adjusted under 35 U.S.C. 154(b) by 129 days.

(21) Appl. No.: 14/615,048

(22) Filed: Feb. 5, 2015

(65) Prior Publication Data

US 2015/0273932 A1 Oct. 1, 2015

Related U.S. Application Data

(63) Continuation-in-part of application No. 13/430,640, filed on Mar. 26, 2012, now Pat. No. 8,985,882.

(60) Provisional application No. 61/561,481, filed on Nov. 18, 2011.

(51) Int. Cl.

| | |
|---|---|
| ***B43K 24/02*** | (2006.01) |
| ***B43K 8/24*** | (2006.01) |
| ***B43K 7/12*** | (2006.01) |
| ***B43K 23/12*** | (2006.01) |
| ***B43K 24/06*** | (2006.01) |

(52) U.S. Cl.

CPC ..... *B43K 24/026* (2013.01); *B43K 7/12* (2013.01); *B43K 8/24* (2013.01); *B43K 23/126* (2013.01); *B43K 24/06* (2013.01); *Y10T 29/49826* (2015.01)

(58) Field of Classification Search

CPC ..... B43K 24/06; B43K 8/24; B43K 7/12
USPC ..... 401/110, 116, 117
See application file for complete search history.

(56) References Cited

U.S. PATENT DOCUMENTS

| | | | | |
|---|---|---|---|---|
| 4,511,273 | A | 4/1985 | Trotta | |
| 4,844,640 | A * | 7/1989 | Ganz | B43K 24/06 401/109 |
| 7,452,149 | B2 | 11/2008 | Saito | |
| 2003/0129014 | A1 | 7/2003 | Bauer et al. | |
| 2005/0078999 | A1* | 4/2005 | Kato | B43K 7/005 401/117 |
| 2005/0214057 | A1* | 9/2005 | Kato | B43K 7/005 401/116 |

* cited by examiner

*Primary Examiner* — Jennifer C Chiang
(74) *Attorney, Agent, or Firm* — Taft Stettinius & Hollister, LLP; Daniel Krieger

(57) ABSTRACT

A retractable ink pen including an elongate ink cartridge having a writing end and an exposed ink opening, wherein the writing end moves from a retracted position to an extended position for writing. The retractable ink pen includes a cap including a recess with an inner surface having one of: i) a position structure, and ii) both a first locator and a second locator spaced a distance from the first locator along a first longitudinal axis. The retractable ink pen further includes an elongate barrel including an outer surface having the other of the position structure and both the first locator and the second locator, wherein the position structure is located at the first locator when the writing end is in the retracted position and wherein the locating structure is located at the second locator when the writing end is in the extended position.

21 Claims, 13 Drawing Sheets

RETRACTABLE WRITING INSTRUMENT

CROSS-REFERENCE TO RELATED APPLICATION

This application is a continuation-in-part of patent application Ser. No. 13/430,640, filed Mar. 26, 2012, having the title "Two Piece Twist Action Retractable Writing Instrument", which claims priority to provisional patent application Ser. No. 61/561,481, filed Nov. 18, 2011, both of which, in their entirety, are incorporated herein by reference.

SUMMARY

The present invention provides a retractable writing instrument with a mechanism for retracting an ink cartridge which is incorporated into cap and barrel components. Cartridge retraction/extension mechanism features are integral to the barrel and cap, so no additional components are required.

The invention comprises, in one form thereof, a retractable pen including an elongate cartridge having a writing end and an open end. A cap includes a recess having an inner surface having one of a position structure and a locating structure thereon. The cartridge is partially received in the recess such that the open end of the cartridge is fixedly attached to the cap. An elongate barrel includes first and second open ends and a through channel fluidly interconnecting the first and second open ends. A portion of the barrel has an outer surface with the other of a position structure and a locating structure disposed thereon. The portion of the barrel including the first open end is snugly received in the recess such that the position structure locates either the cap or the barrel with respect to the locating structure on the other of the cap or the barrel. The cartridge is received in and extends through the channel. The barrel and the cap are movable relative to each other via engagement of the position structure with the locating structure to provide an extended position in which a writing end of the cartridge extends through and out of the open end of the barrel, and a retracted position in which the writing end of the cartridge is disposed within the barrel.

In one embodiment, there is provided a retractable ink pen including an elongate ink cartridge having a writing end and an exposed ink opening, wherein the writing end moves from a retracted position to an extended position for writing. The retractable ink pen includes a cap defining a first longitudinal axis, the cap having a recess with an inner surface having one of: i) a position structure, and both a first locator and a second locator spaced a distance from the first locator along the first longitudinal axis. An elongate barrel defines a second longitudinal axis aligned with the first longitudinal axis wherein the elongate barrel includes an outer surface having the other of the position structure and both the first locator and the second locator. The position structure is located at the first locator when the writing end is in the retracted position and the locating structure is located at the second locator when the writing end is in the extended position.

In another embodiment, there is provided a method of assembling a retractable ink pen including an elongate ink cartridge having a writing end and an exposed ink opening, wherein the writing end moves from a retracted position to an extended position for writing. The method of assembling includes: providing the elongate ink cartridge; providing a cap defining a first longitudinal axis, the cap including an open end and a recess having an inner surface including one of: i) a position structure, and both a first locator and a second locator spaced a distance from the first locator along the first longitudinal axis; providing an elongate barrel defining a second longitudinal axis, the elongate barrel including an open end and an outer surface having the other of the locating structure and both the first locator and the second locator; inserting the cartridge into one of the cap and the elongate barrel; inserting the open end of barrel into the open end of the cap to align the first longitudinal axis with the second longitudinal axis; and moving the position structure to engage the first locator.

In still another embodiment, there is provided a retractable ink pen including an elongate ink cartridge having writing end and an exposed ink opening, wherein the writing end moves from a retracted position to an extended position for writing. The retractable ink pen includes a cap defining a first longitudinal axis, the cap including a recess having an inner surface including one of: i) a positioning ring, and ii) both a first groove and a second groove spaced a distance from the first groove along a first longitudinal axis of the cap. An elongate barrel defines a second longitudinal axis aligned with the first longitudinal axis, the elongate barrel including an outer surface having the other of the ring and both the first groove and the second groove, wherein the ring is located at the first groove when the writing end is in the retracted position and wherein the ring is located at the second groove when the writing end is in the extended position.

An advantage of the present invention is that the two-piece construction provides inexpensive component costs and assembly methods. The lack of a spring, while still providing a retractable ink cartridge pen, also reduces costs.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 18:
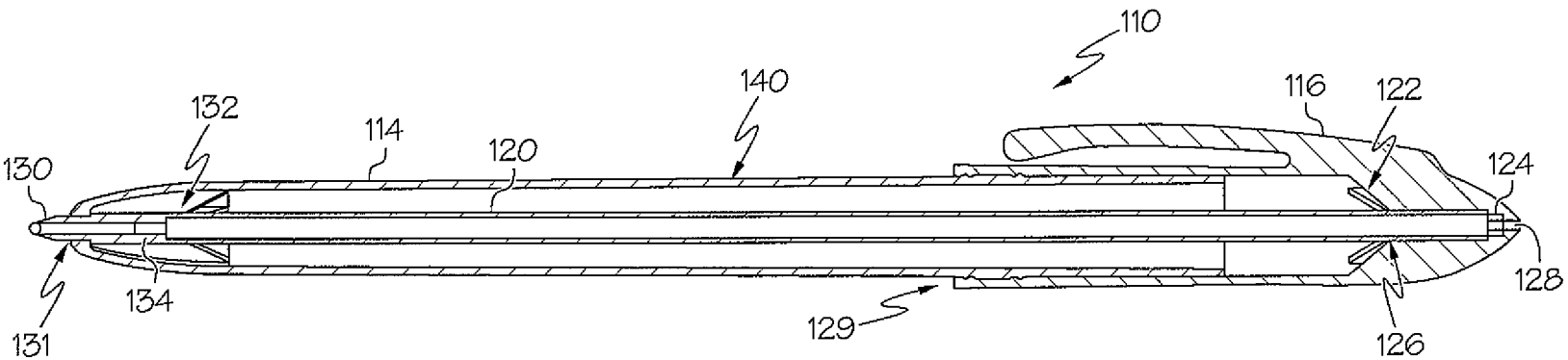
FIG. 18 is a side cross-sectional view of the pen of FIG. 17 taken along line 18-18.
Figure 19:
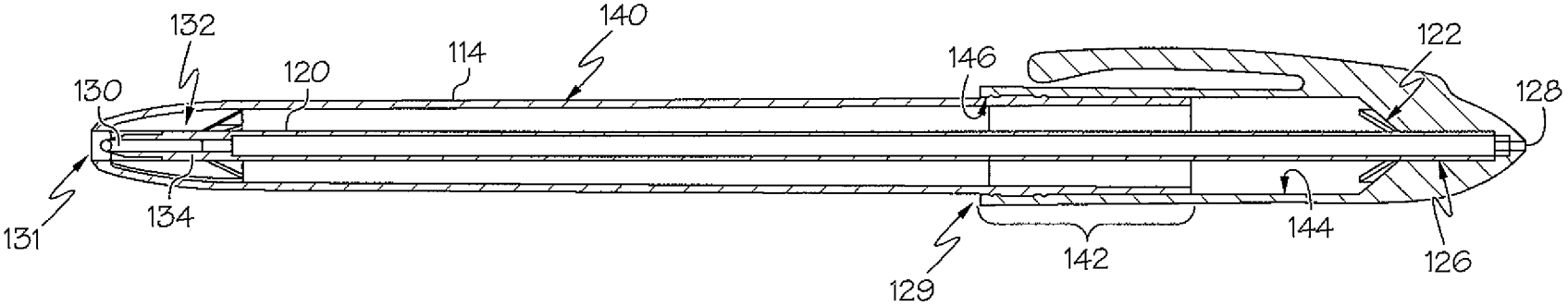
FIG. 19 is a side cross-sectional view of the pen of FIG. 18 in a retracted position.
Figure 20:
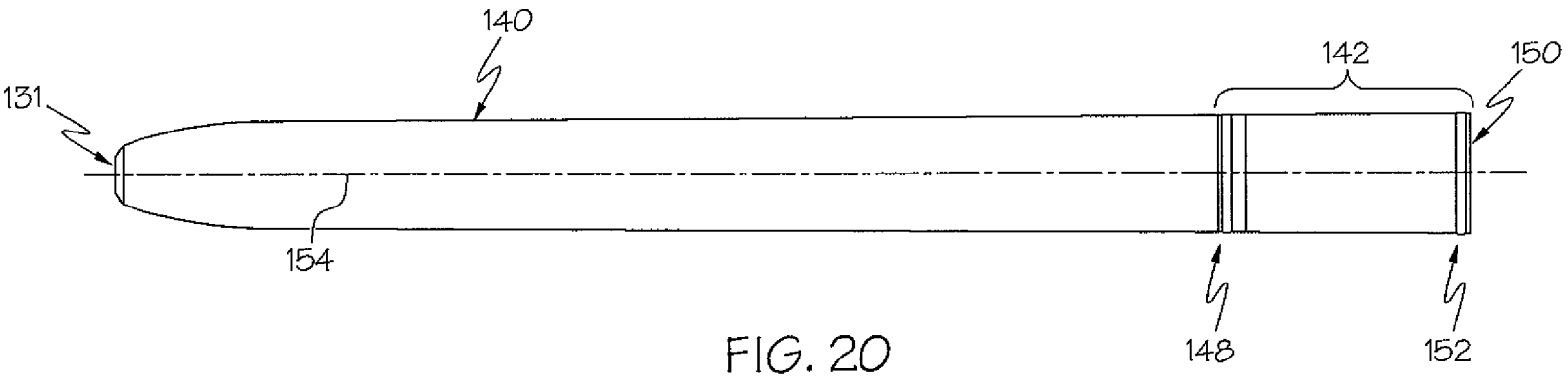
Figure 22:
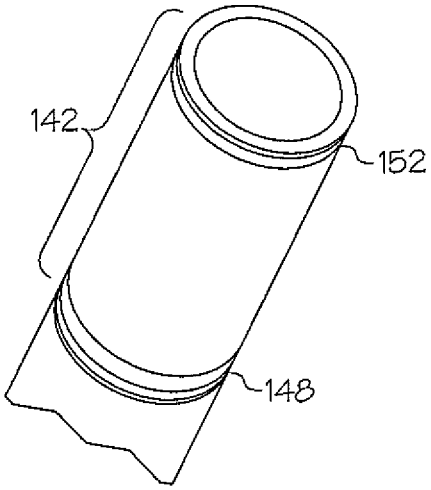
Figure 23:
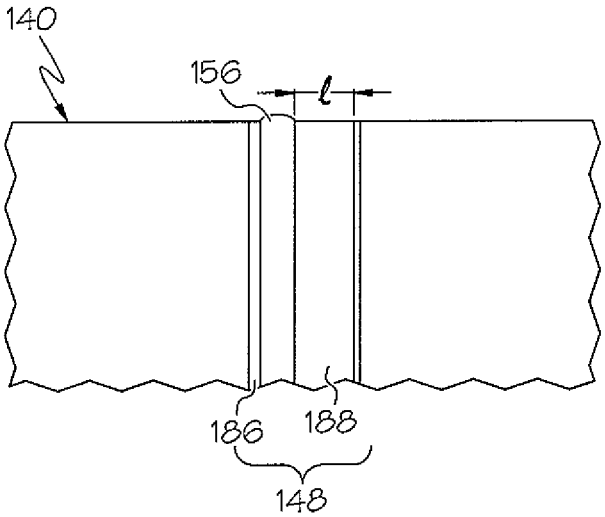
Figure 24:
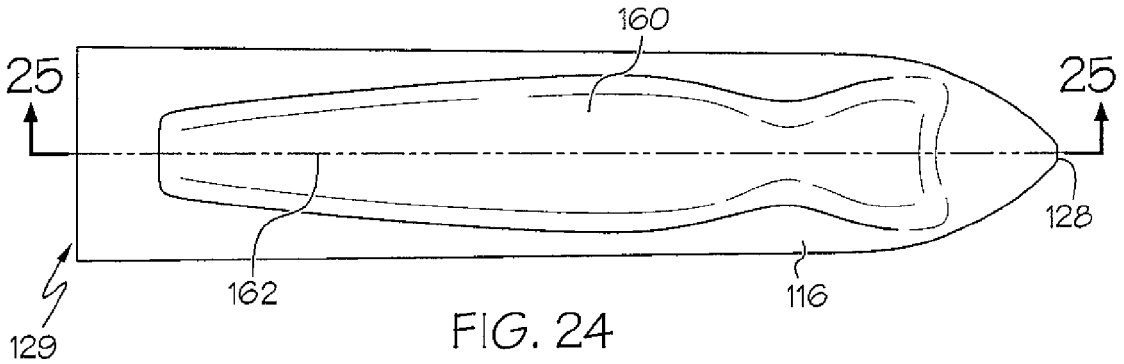
Figure 25:
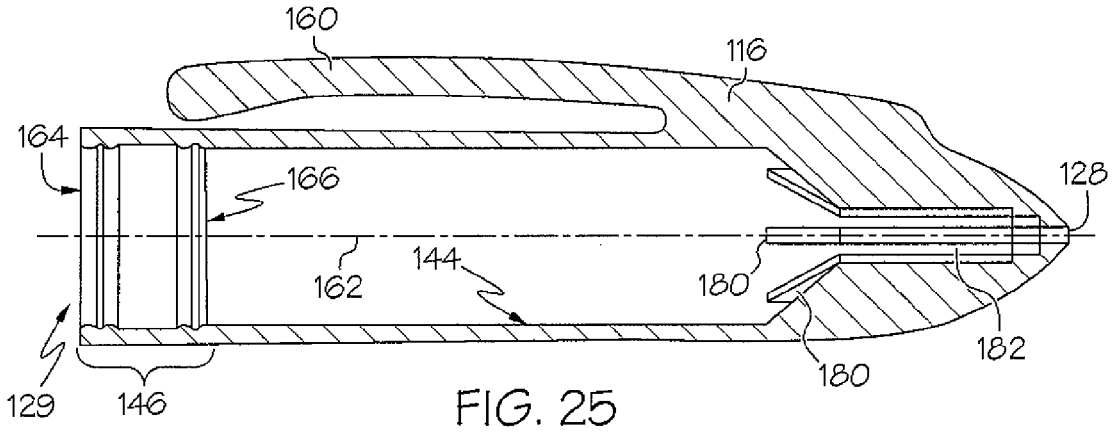
Figure 26:
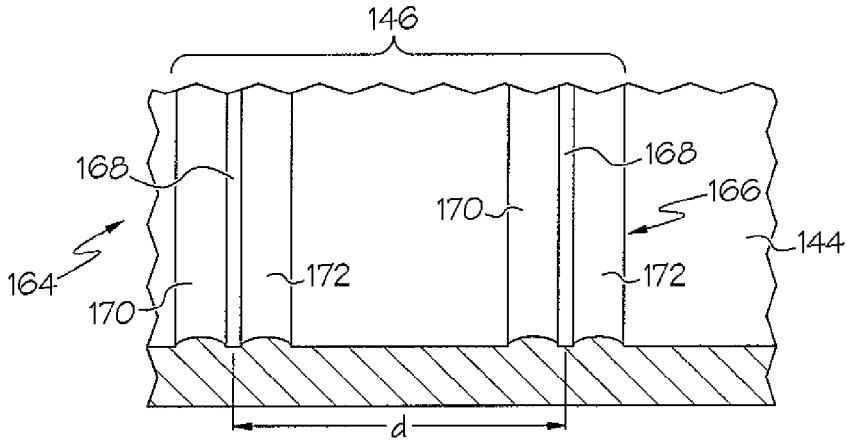

FIG, 20 is a side view of the barrel of FIG. 19;

FIG, 21 is a perspective view of one end of the barrel of FIG. 19;

FIG. 22 is an end view of another end of the barrel of FIG. 20;

FIG. 23 is a partial exploded view of the ring structure of the barrel of FIG. 20;

FIG. 24 is a side view of the cap of the pen of FIG. 18;

FIG. 25 is a sectional view of the cap of the pen of FIG. 18 taken along line 25-25; and FIG. 26 is a partial exploded view of the groove structure of FIG. 25.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 1:
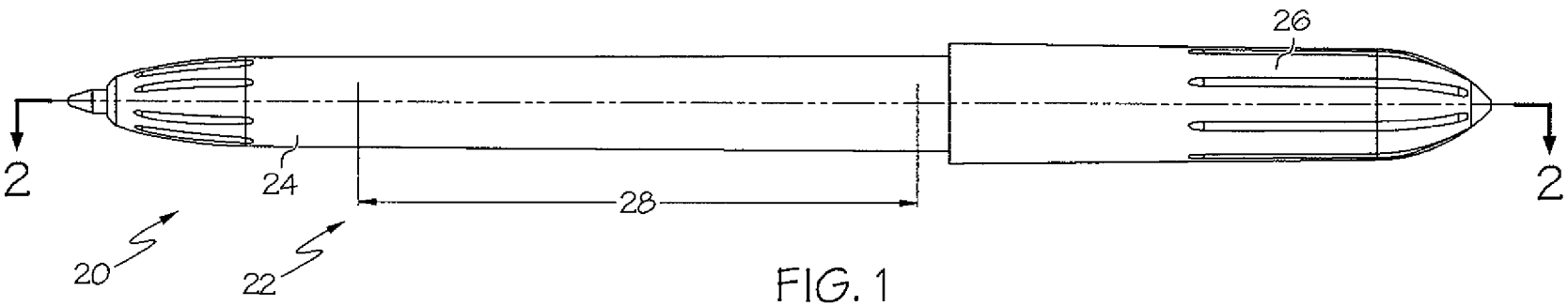
FIG. 1 is a side view of one embodiment of a pen of the present invention in an extended position.

Referring to the drawings, wherein like numerals indicate like elements, FIG. 1 shows one embodiment of a pen 20 of the present invention. Pen 20 includes a two-piece body 22, having a barrel 24 and a cap 26 which is threadedly coupled to barrel 24. Barrel 24 includes a smooth, continuous and annular imprint area 28 on which logos and/or lettering may be printed. However, it is also possible for the portion of barrel 24 including imprint area 28 to have a polygonal cross section. For example, the portion of barrel 24 including imprint area 28 may have a triangular cross section, thereby providing a flat imprint area on which logos and/or lettering may be printed.

Figure 2:
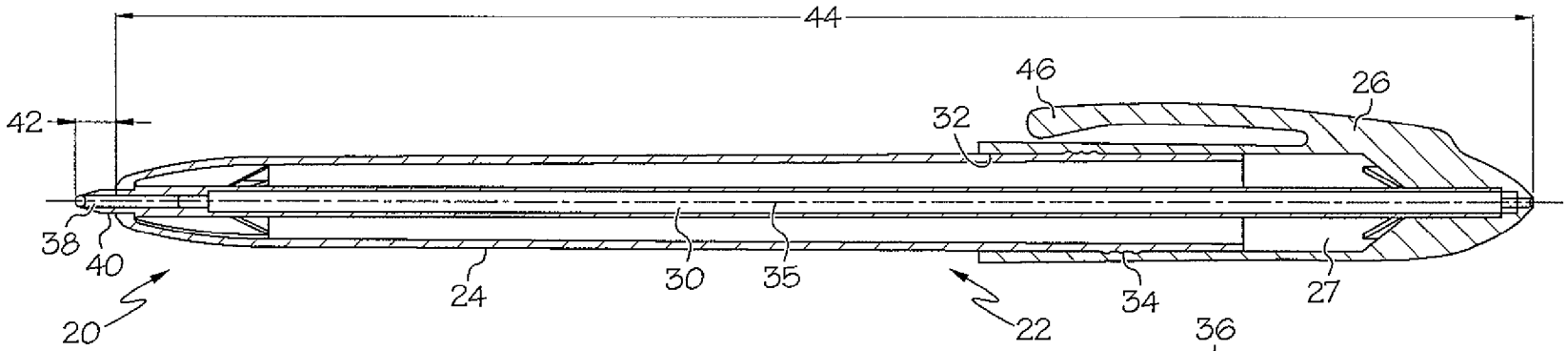
FIG. 2 is a side cross-sectional view of the pen of FIG. 1 taken along line 2-2.

FIG. 2 illustrates a cross-sectional view of pen 20 along line 2-2. An ink cartridge 30 is held firmly in, and is fixedly attached to, cap 26. The cap 26 defines an interior space or recess 27, located inside the cap 26. An interior surface 32 of cap 26 is threaded, and an exterior surface 34 of barrel 24 is correspondingly threaded and received in the recess 27 such that the threads of the interior surface 32 and the threads of the exterior surface 34 are in threaded engagement with each other. The threads on both surfaces 32, 34 may be male. That is, the threads may extend radially outward from surfaces 32, 34. The mating threads on surfaces 32, 34 enable barrel 24 to be screwed inside cap 26. More particularly, barrel 24 and cap 26 may be rotated relative to each other about an imaginary longitudinal axis 35 that is approximately defined by cartridge 30. As barrel 24 is screwed in and out of cap 26 in directions indicated by double arrow 36, pen 20 is moved between an extended position shown in FIGS. 1 and 2 and a retracted position shown in FIGS. 3 and 4. In the extended position, a tip 38 of ink cartridge 30 projects through a through hole 40 in the distal end of barrel 24. Through hole 40 may have a diameter about 1 millimeter larger than the diameter of the portion of cartridge 30 that extends through through hole 40. Thus, cartridge 30 may move freely through through hole 40, but the lateral movement or sway of cartridge 30 may be effectively limited by through hole 40. A distance 42 that tip 38 extends beyond barrel 24 may be approximately between 0.10 and 0.16 inch in one embodiment. A length 44 between the distal tip of barrel 24 and a distal end of cap 26 in the extended position of FIGS. 1 and 2 may be approximately between 5.38 and 5.58 inch in one embodiment. Cap 26 may include a conventional clip 46.

Figure 3:
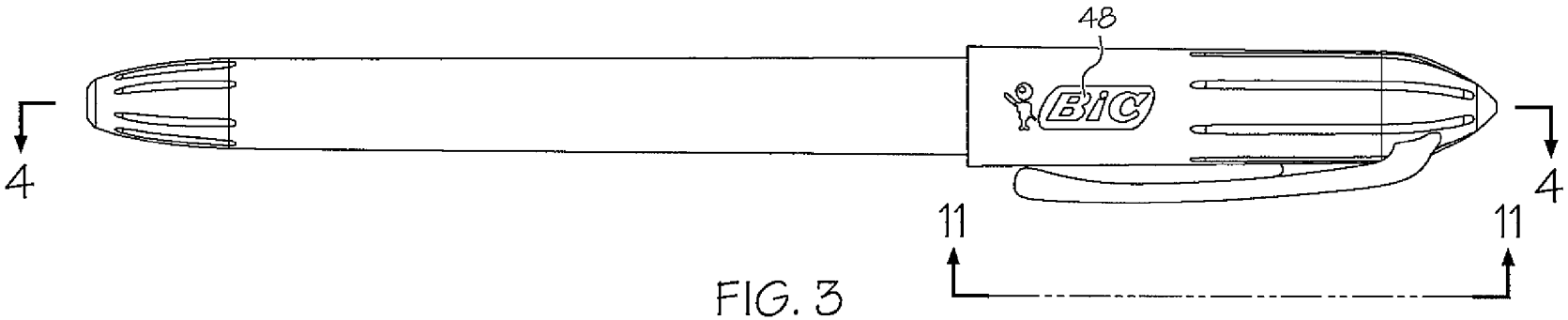
FIG. 3 is a side view of the pen of FIG. 1 in a retracted position.
Figure 4:
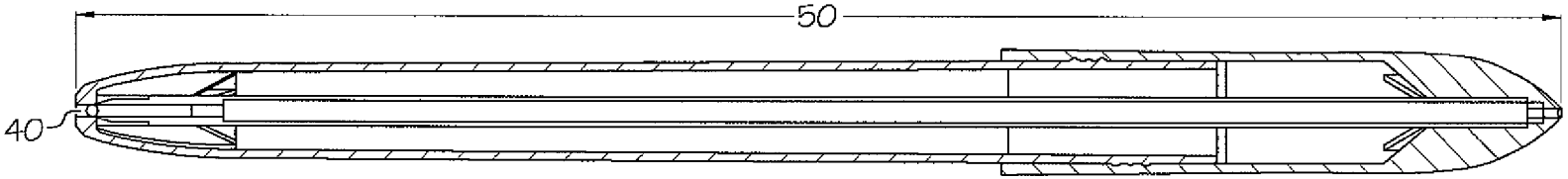
FIG. 4 is a side cross-sectional view of the pen of FIG. 3 taken along line 4-4.

As shown in FIG. 3, cap 26 includes a smooth, continuous and annular imprint area 48 on which logos and/or lettering may be printed. However, it is also possible for the portion of cap 26 including imprint area 48 to have a polygonal cross section. For example, the portion of cap 26 including imprint area 48 may have a triangular cross section, thereby providing a flat imprint area on which logos and/or lettering may be printed. A length 50 (FIG. 4) between the distal tip of barrel 24 and a distal end of cap 26 in the retracted position of FIGS. 3 and 4 may be approximately between 5.52 and 5.72 inch in one embodiment.

Figure 5:
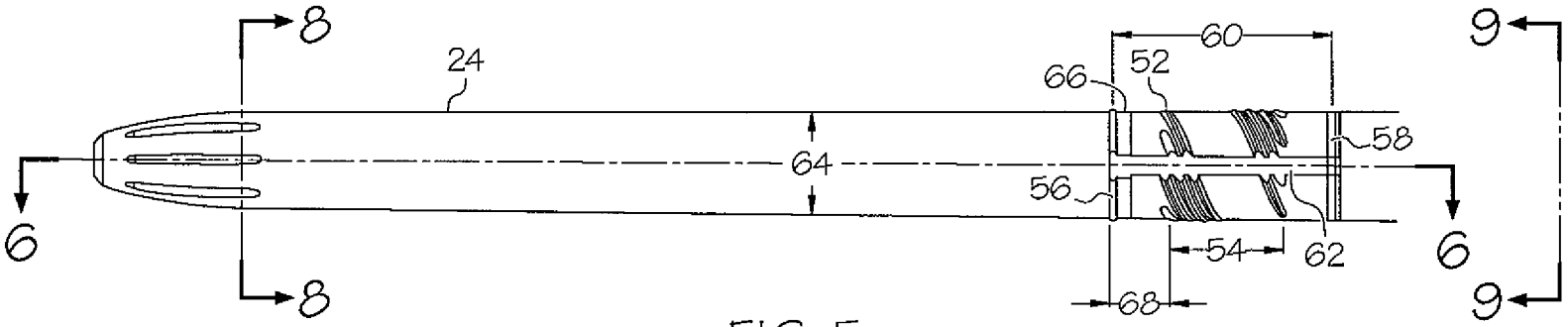
FIG. 5 is a side view of the barrel of the pen of FIG. 1.

As shown in FIG. 5, barrel 24 may include threads in the form of, for example, four leads 52, each of which extends about 360 degrees around barrel 24 over a length 54 of about 0.4 inch. Two rings 56, 58 are disposed on opposite sides of leads 52. In one embodiment, rings 56, 58 are separated by a distance 60 of about 0.76 inch. Rings 56, 58 include are attached to each other by two opposing flats or a bars 62 which hold rings 56, 58 in fixed position relative to each other and which are in diametrically opposed positions on barrel 24. A diameter 64 of barrel 24 may be about 0.376 inch, and a diameter of each of rings 56, 58 may be about 0.386 inch. Attached to and adjacent to ring 56 is an annular shoulder 66 having an intermediate diameter between the diameter of barrel 24 and the diameter of rings 56, 58. For example, the diameter of should 66 may be about 0.380 inch. A distance 68 between ring 56 and an end of leads 52 may be about 0.200 inch.

Figure 6:
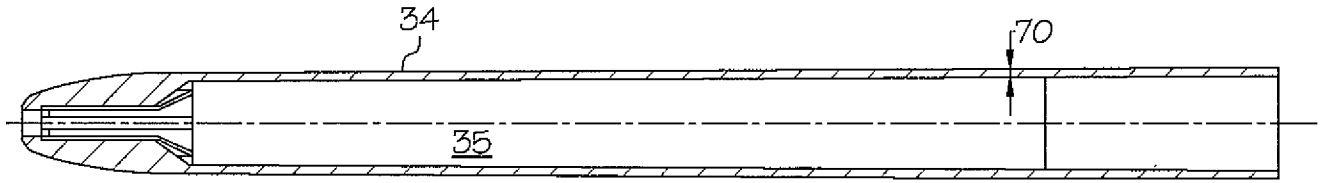
FIG. 6 is a front cross-sectional view of the barrel of FIG. 5 along line 6-6.
Figure 7:
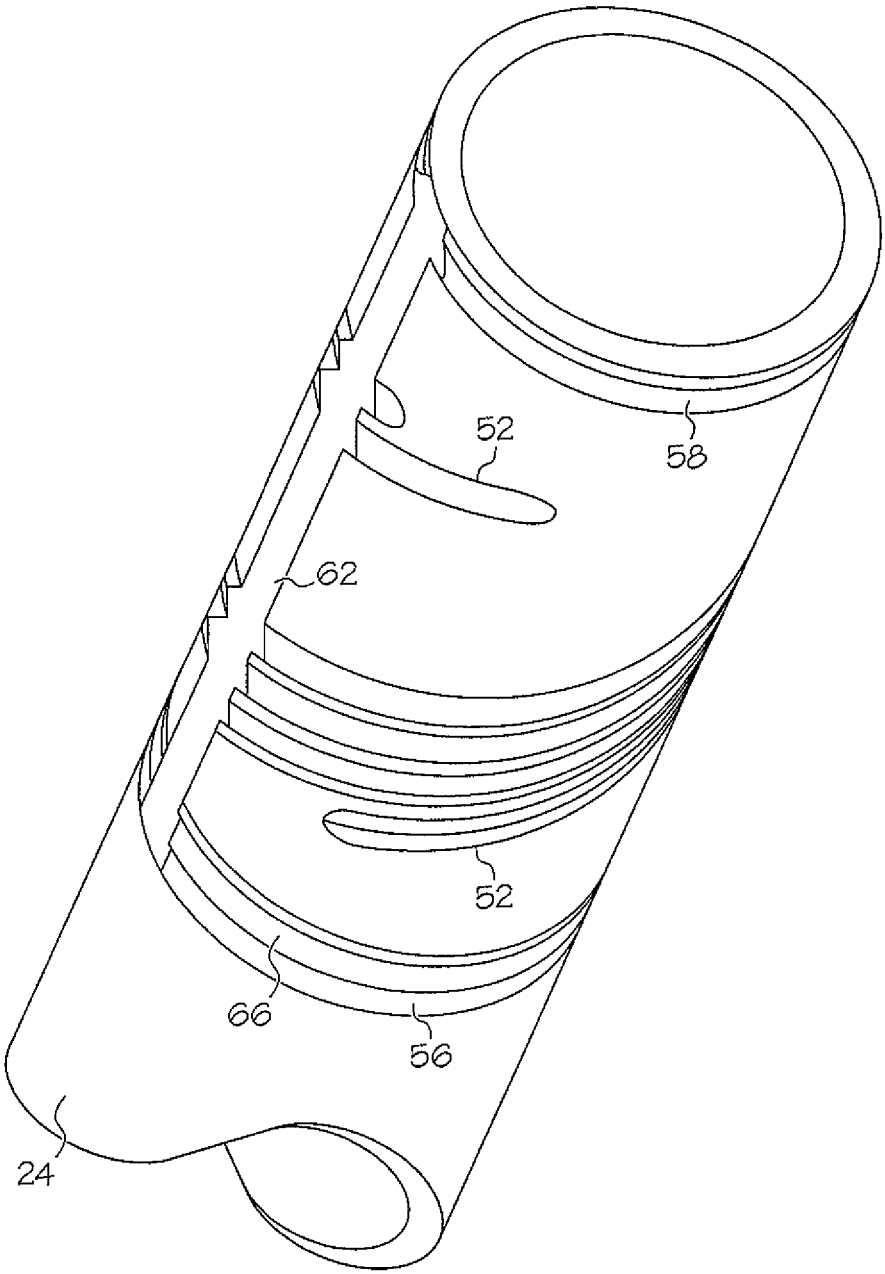
FIG. 7 is a fragmentary perspective view of the rear end of the barrel of FIG. 5.
Figure 9:
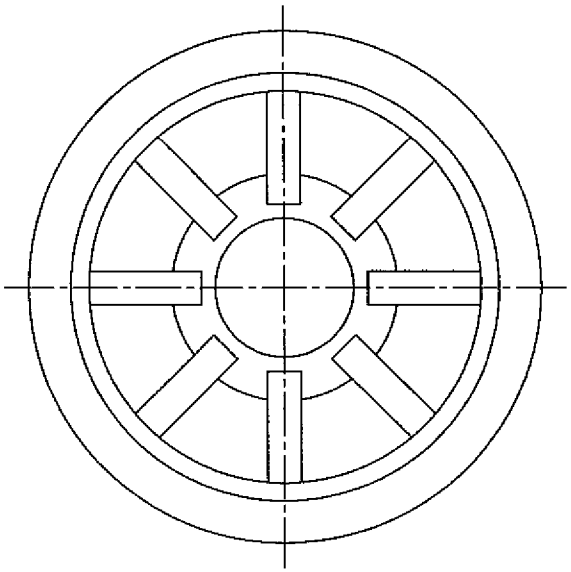
FIG. 9 is a rear view of the barrel of FIG. 5 along line 9-9.
Figure 8:
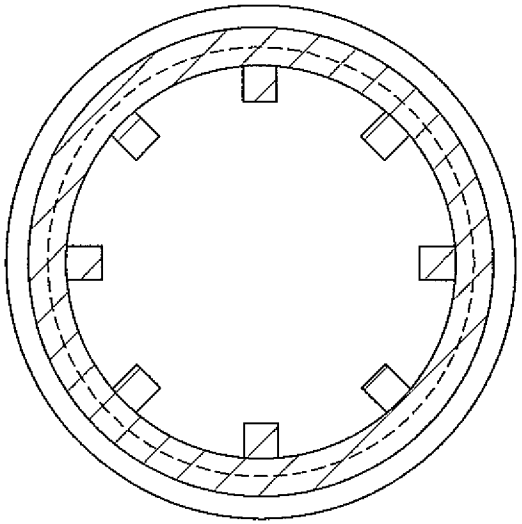
FIG. 8 is a cross-sectional view of the barrel of FIG. 5 along line 8-8.

A wall thickness 70 (FIG. 6) of barrel 24 may be about 0.030 inch. As best shown in FIG. 6, barrel 24 includes a through channel 35 between two opposite open ends. Cartridge 30 may extend through through channel 35, and, in the extended position, may extend through both of the two opposite open ends of barrel 24.

Figure 10:
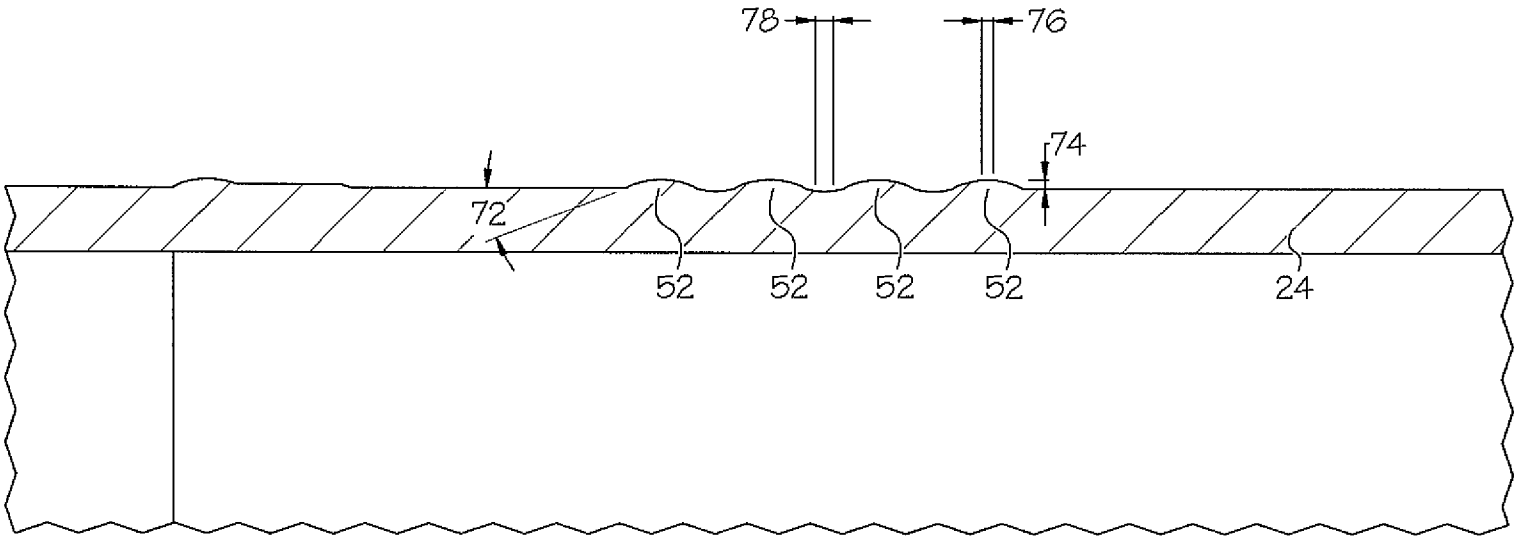
FIG. 10 is a fragmentary cross-sectional view of the threads of the barrel of FIG. 6.
Figure 11:
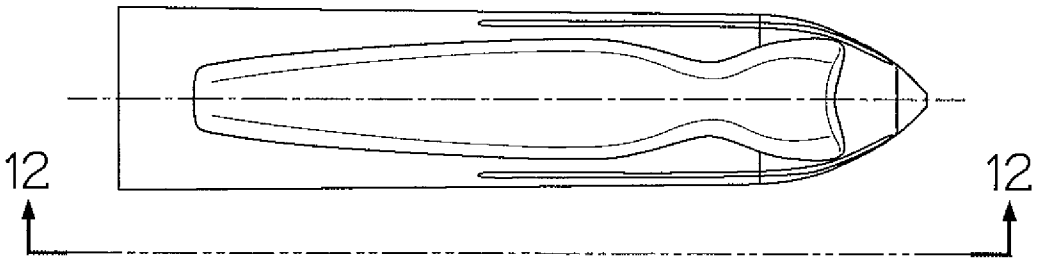
FIG. 11 is a view of the cap along line 11-11 of FIG. 3.

An enlarged cross-sectional view of leads 52 is shown in FIG. 10. An angle of slope 72 of leads 52 may be about 20 degrees. A height 74 of leads 52 may be about 0.005 inch. A width 76 of leads 52 may be about 0.010 inch. A distance 78 between leads 52 may be about 0.013 inch.

Figure 12:
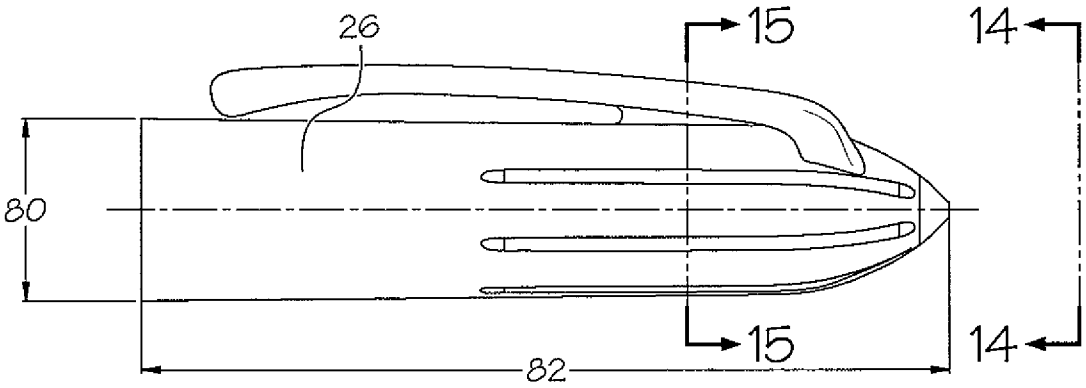
FIG. 12 is a view of the cap along line 12-12 of FIG. 11.
Figure 13:
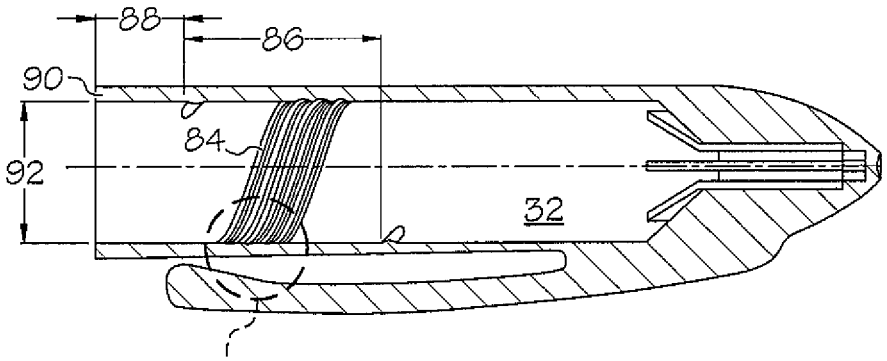
FIG. 13 is a cross-sectional view of the cap along line 13-13 of FIG. 11.
Figure 14:
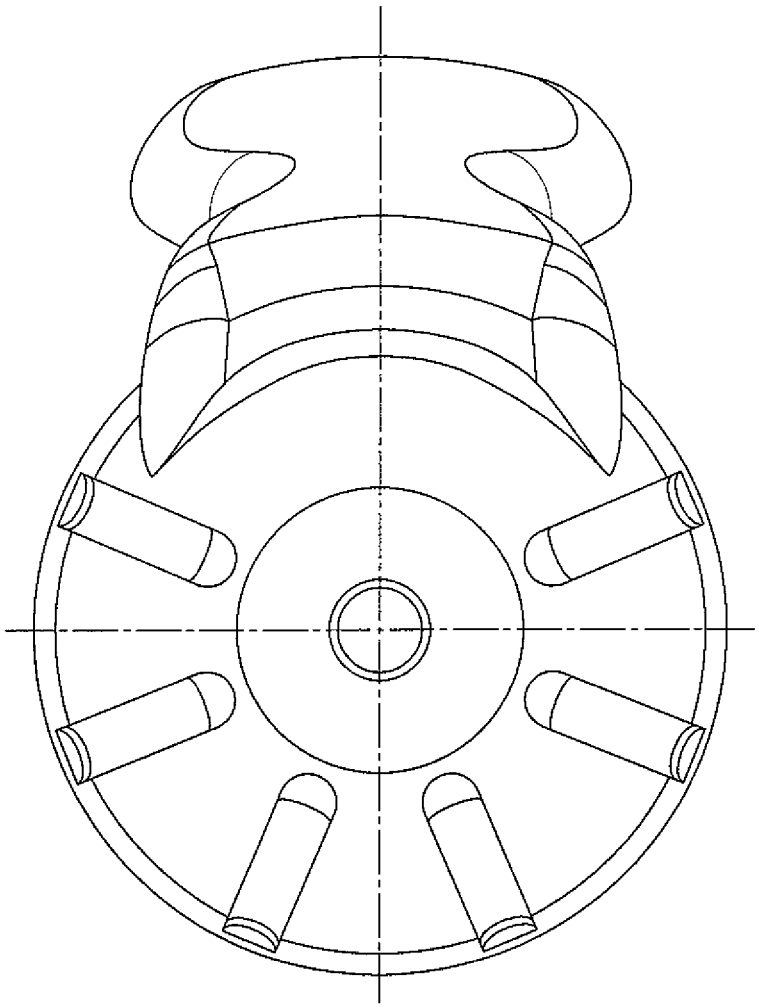
FIG. 14 is an end view of the cap along line 14-14 of FIG. 12.
Figure 15:
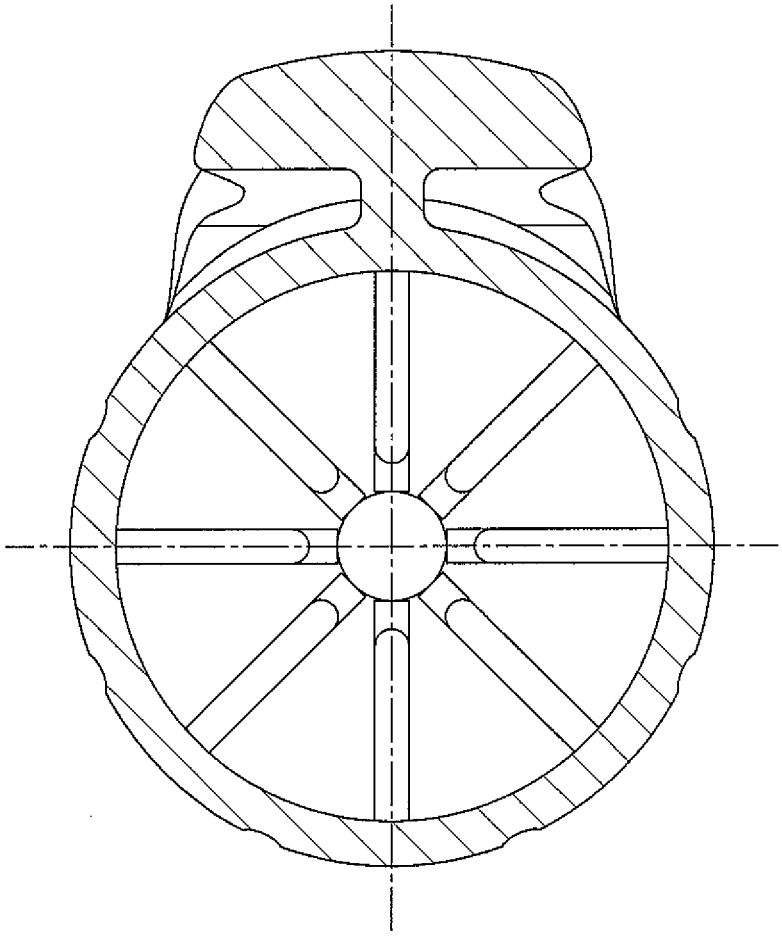
FIG. 15 is a cross-sectional view of the cap along line 15-15 of FIG. 12.

As shown in FIG. 12, a width 80 of cap 26 may be about 0.465 inch. A length 82 of cap 26 may be about 2.125 inch. As shown in FIG. 13, annular interior surface 32 of cap 26 may include threads in the form of, for example, four leads 84, each of which extends about 360 degrees around annular interior surface 32. The combination of four leads 84 spans a length 86 of about 0.510 inch. A pitch of leads 84 may be about 0.4 inch, just as with leads 52. A distance 88 between an open end 90 of cap 26 and an end of leads 84 may be about 0.230 inch. An inner diameter 92 of cap 26 may be about 0.390 inch.

Figure 16:
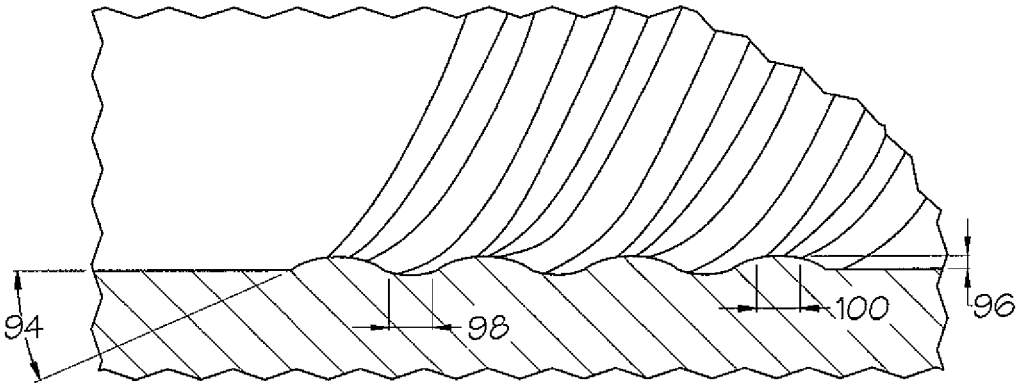
FIG. 16 is an enlarged view of area 16 in FIG. 13.

An enlarged cross-sectional view of leads 84 is shown in FIG. 16. An angle of slope 94 of leads 84 may be about 20 degrees. A height 96 of leads 84 may be about 0.005 inch.

A width 98 of leads 84 may be about 0.013 inch. A distance 100 between leads 84 may be about 0.010 inch.

During assembly, barrel 24 and cap 26 may be pushed together without the need for rotation or axial alignment. During use, ring 58 may abut against or engage one end of leads 84 of cap 26 in the extreme retracted position of pen 20 to thereby prevent cap 26 from separating from barrel 24. Similarly, shoulder 66 and ring 56 may abut against or engage the other end of leads 84 of cap 26 in the extreme extended position of pen 20 to thereby prevent cartridge 30 from extending too far out from barrel 24.

In one embodiment, a distance of travel of cap 26 and cartridge 30 relative to barrel 24 between the retracted and extended positions may be about 0.133 inch. This travel distance of 0.133 inch may correspond to a rotation of about 120 degrees, or one-third of a rotation, of cap 26 relative to barrel 24, assuming a 0.4 inch pitch of the threads per rotation.

Figure 17:
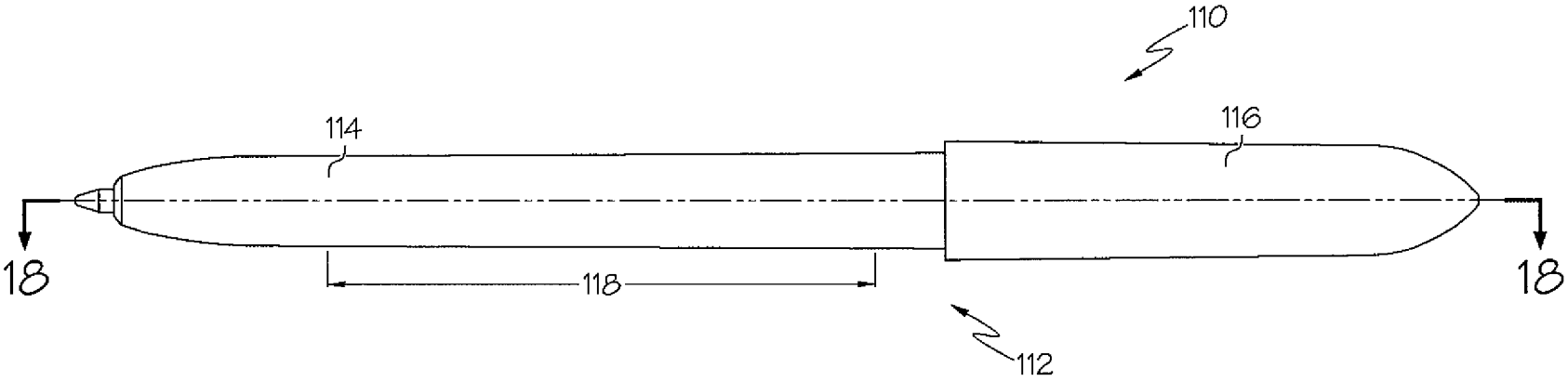
FIG. 17 is a side view of another embodiment of a pen of the present invention in an extended position.

FIG. 17 illustrates another embodiment of a pen 110 of the present invention. Pen 110 includes a two-piece body 112, having a barrel 114 and a cap 116 which is movably coupled to the barrel 114. Barrel 114 includes a smooth, continuous and annular imprint area 118 on which logos and/or lettering may be printed. However, it is also possible for the portion of barrel 114 including imprint area 118 to have a polygonal cross section. For example, the portion of barrel 114 including imprint area 118, in different embodiments, includes a triangular cross section, thereby providing a flat imprint area on which logos and/or lettering may be printed.

The pen 110 of FIG. 18, as shown in a cross-sectional view of pen 110 of FIG. 17 along line 18-18, does not include a spring, which is typically required in a retractable ink cartridge pen to provide a retractable ink cartridge. An ink cartridge 120 is held firmly in, and is fixedly attached to, the cap 116. The cap 116 includes a coupler 122 into which an open end 124 of the ink cartridge 120 is inserted. The coupler 122 is configured to receive an end portion 126 of the ink cartridge 120 and to hold the ink cartridge 120 at a fixed location with respect to the cap 116. The cap 116 further includes a hole or aperture 128 which is disposed adjacently to the open end 124 of the cartridge 120 when fixed to the cap 116. In this way, atmospheric pressure is provided to the ink cartridge 120, such that the ink cartridge 120 dispenses ink from an ink cartridge tip 130 when required. The hole 128 is a through hole extending to an interior of the cap 116 which is open to an open end 129 of the cap 116 into which the barrel 114 is inserted.

Figure 21:
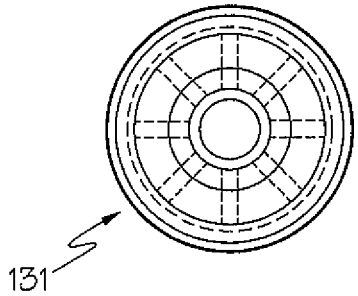

The tip 130 is captured and guided by an open end 131 of the barrel 114 which includes a guide structure 132 therein configured to locate a portion 134 of the cartridge 120. The portion 134 stabilizes the extended tip 130 for writing and also provides for guided movement of the cartridge 120 from the retracted position to the extended position and from the extended position to the retracted position. The open end 131 is also shown in FIG. 21.

An exterior surface 140 of barrel 114 includes a position structure 142, which is further illustrated in FIG. 22. An interior surface 144 of cap 116 includes a locating structure 146, which is further illustrated in FIGS. 25 and 26. The position structure 142 and locating structure 146 are configured to engage one another and to define a first position and a second position of the cap 116 with respect to the barrel 114, wherein the first position defines the location of the retracted cartridge of FIG. 19 and the second position defines the location of the extended cartridge of FIG. 18. The position structure 142, therefore, engages the locating structure 146 in at least two locations to thereby define the position of the cap 116 with the barrel 114 for retraction and extension of the cartridge 120 with respect to the barrel 114. In another embodiment, the position structure 142 is located at the cap 116 and the locating structure 146 is located at the barrel 114.

In one embodiment, as illustrated in FIG. 20, the position structure 142 includes a first ring structure 148, or position ring, disposed at the surface 140. A second ring structure 152 is located adjacently to a first open end 150 of the barrel 114. The first ring structure 148 is located between the first ring structure 152 and the open end 131 of the barrel 114. The surface 140 defines a planar surface extending generally parallel to a longitudinal axis 154 defined by the barrel 114. As shown in FIG. 23, the first ring structure 148 includes a raised portion 156 which is raised with respect to the surface 140, such that a radius of the raised portion 156 is greater than a radius of the surface 140. Likewise the second ring structure 152 includes a raised portion which is raised with respect to the surface 140, such that a radius of the raised portion is greater than a radius of the raised surface 140. In one embodiment as illustrated in FIG. 22, each of the first ring and second ring structures 148 and 152 completely encircle the outer circumference of the barrel 114. In other embodiments, one or both of the first and second ring structures 148 and 152 are not continuous, but are discontinuous, but still sufficiently configured to contact the locating structure 146 when the cartridge 120 is extended or retracted. In one or more embodiments, the first ring structure 148 and the second ring structure 152 include a circumferential rib raised with respect to the surface 140.

The cap 116 is further illustrated in FIG. 24 and includes a conventional clip 160 which extends along a longitudinal axis 162 of the cap 116. When the cap 116 is coupled to the barrel 114, the longitudinal axis 162 is aligned with the longitudinal axis 154 of the barrel 116.

As further illustrated in FIG. 25, the locating structure 146 includes a first locator 164 and a second locator 166, each of which is configured to engage the ring structure 142 of the barrel 116. Each of the first and second locators 164 and 166 include a recessed portion 168 which is defined between a first stop 170 and a second stop 172. Each of the first and second stops 170 and 172 include a raised portion, which is raised or elevated with respect to a plane defined by the interior surface 144 of the cap 116. In one embodiment, the recessed portion 168 is recessed with respect to the first and second stops 170 and 172. In another embodiment, the recessed portion 168 is recessed with respect to the surface 144. In different embodiments, the first and second stops 170 and 172 extend from the surface 144 the same distance, while in other embodiments, the first and second stops 170 and 172 are of different heights. In other embodiments, the recessed portion 168 is: i) a groove defined by the first stop 170 and the second stop 170; ii) is a groove formed in the surface 144; or iii) a groove formed in the surface adjacent to one or both of a one of the stops 170 and 172. In still other embodiments, the grooves 168 and first and second stops 170 and 172 define a circumference disposed substantially perpendicular to the axis 162.

Each of the recessed portions 168, located at the first and second locators 164 and 166, are spaced a distance "d" apart. The distance "d" between the first and second locators 164 and 166 is selected to locate the tip 130 of the cartridge in one of the extended position of FIG. 18 and the retracted position of FIG. 19. In the retracted position, the raised portion 158 is located at the recessed portion 168 of the second locator 166. In the extended position, the raised portion 158 is located at the recessed portion 168 of the first locator 164.

The pen 100 includes three parts, the barrel 114, the cap 116, and the cartridge 120. To assemble the pen 100, the end 124 of the cartridge 120 is inserted into the open end 129 of the cap 116 and through the coupler 122 until the end of the cartridge 120 engages in inner portion of the coupler 122 which prevents further movement of the cartridge 120 into the cap 116. The coupler 122, in one embodiment as illustrated in FIG. 25, includes a plurality of fins 180, each of which are spaced about the longitudinal axis 162 of the cap 116. Each of the fins 180 extends toward the axis 162 to define a space 182 which captures the end portion 126 of the cartridge 120. In one embodiment, the cap 116 is made of a plastic, such that the fins 180 are resilient so that the cartridge is fixedly located in the space 182 and held in place by force exerted on the cartridge 120 by the fins 180.

Once the cartridge 120 is located within the cap 116, the tip end 130 of the cartridge 120 is inserted in the first open end 150 of the barrel 114. The open end 150 of the barrel 120 is then inserted into the open end 129 of the cap 116 and one of the barrel 120 and the cap 116 are moved with respect to the other along the aligned longitudinal axis 154 and 162. The second ring structure 152 is moved to a location between the second locator 166 and the fins 180. In one embodiment, the second ring structure 152 provides an indication of the distance required to further insert the barrel 114 into cap 116 to engage the first ring structure 148 with the first locator 164.

Once the second ring structure 152 moves past the second locator 166, the barrel 114 is further inserted into the cap 116 such that the first ring structure 148 moves into engagement with the first locator 164. Once the first ring structure 148 is located at the recessed portion 168 of the first locator 164, the assembly of the pen is complete. In addition, once the first ring structure 148 is located at the recessed portion 168 of the first locator 164, the cartridge tip 130 is fully recessed within the barrel 114, the retracted position.

If the first ring structure 148 is disengaged from the first locator 164, moved between the first locator 164 and second locator 166, and then into engagement with the second locator 166, the ink cartridge 120 is in the extended position. Since the cartridge 120 is fixed to the cap, movement of the barrel with respect to the cap, or vice versa, moves the cartridge 120 from the extended position to the retracted position, even in the absence of a spring to assist cartridge movement as is found in a retractable ink pen having a spring.

Once assembly is completed and to prepare the pen for writing, a user of the pen moves or slides the barrel 114 with respect to the cap 116 to expose the tip 130 in the extended position. To extend the cartridge for writing, the barrel 114 is moved further into the cap 116. The barrel 114 is moved toward the cap 116, such that the first ring structure 148 is disengaged from the first locator 164, moved toward the second locator 166, and into engagement with the recessed portion 168 of the second locator 166.

Movement of the first ring structure 148 into and out of engagement with each of the recessed portions 168 of the first locator 164 and second locator 166 provides a tactile response or an audible response, such as a "click", indicating to a user that the cartridge 120 is appropriately located in either the extended or retracted position.

The separation force necessary to disengage the first ring structure 148 from the second locator 166 is insufficient to prevent the disengagement of the first ring structure 148 from the second locator 166 during a writing operation, should the cap 116 be held during the writing operation. Consequently, after a writing operation is finished, the amount of force required to move the first ring structure 148 from the second locator 166 to the first locator 164 is generally greater than the amount of force applied to the tip 130 during a writing operation.

In one embodiment to facilitate movement of the first ring structure 148 from one of the first and second locators 164 and 166 to the other of the first and second locators, a first engaging portion 186 and a second engaging structure 188 are located on either side of the raised portion 156. Each of the engaging portions 186 and 188 include raised surfaces which extend from the surface 140 of the barrel 114. Each of the raised surfaces, however, includes a height which is less than a height of the raised portion 156. The engaging structures 186 and 188 thereby moderate a transitional force which could be required between movement of the raised portion 156 to one of the recessed portions 168, if one or both of the engaging structures 186 and 188 were not included. In one or more embodiments, the heights of the engaging structures 186 and 188 are the same or different. Additionally, a length "l" of the engaging structures 186 and 188, in different embodiments, are the same or different, depending on the amount of transitional force desired for moving between extended and retracted positions.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A retractable ink pen including an elongate ink cartridge having a writing end and an exposed ink opening, wherein the writing end moves from a retracted position to an extended position for writing, the retractable ink pen comprising:

a cap defining a first longitudinal axis, the cap including a recess with an inner surface having one of: i) a position structure, and ii) both a first locator and a second locator spaced a distance from the first locator along the first longitudinal axis;

an elongate barrel defining a second longitudinal axis aligned with the first longitudinal axis, the elongate barrel including an outer surface having the other of the position structure and both the first locator and the second locator, wherein the position structure is located at the first locator when the writing end is in the retracted position and wherein the position structure is located at the second locator when the writing end is in the extended position wherein the cap includes a coupler configured to fix the location of the cartridge with respect to the cap.

2. The retractable ink pen of claim 1 wherein the cap includes a through hole configured to expose the recess of the cap with atmosphere such that the exposed ink opening of the cartridge is subject to atmospheric pressure located externally to the retractable ink pen.

3. The retractable ink pen of claim 2 wherein the coupler includes a plurality of resilient fins configured to fix the location of the cartridge with respect to the cap.

4. The retractable ink pen of claim 3 wherein the first locator includes a first stop, a second stop, and a first groove disposed between the first stop and the second stop.

5. The retractable ink pen of claim 4 wherein the second locator includes a third stop, a fourth stop, and a second groove disposed between the first stop and the second stop.

6. The retractable ink pen of claim 5 wherein the position structure includes a raised element extending from a surface of one of the cap and one of the barrel, wherein the raised portion is configured to engage the first groove in the retracted position and to engage the second groove in the extended position.

7. The retractable pen of claim 6 wherein the raised element includes a circumferential ring disposed about one of an inner surface of the cap and an outer surface of the barrel.

8. The retractable pen of claim 1 wherein the first locator and the second locator are located at the inner surface of the cap and the position structure is located on the outer surface barrel.

9. A method of assembling a retractable ink pen including an elongate ink cartridge having a writing end and an exposed ink opening, wherein the writing end moves from a retracted position to an extended position for writing, the method of assembling comprising:

providing the elongate ink cartridge;

providing a cap defining a first longitudinal axis, the cap including an open end and a recess having an inner surface including one of: i) a position structure, and ii) both a first locator and a second locator spaced a distance from the first locator along the first longitudinal axis;

providing an elongate barrel defining a second longitudinal axis, the elongate barrel including an open end and an outer surface having the other of the position structure and both the first locator and the second locator;

inserting the cartridge into one of the cap and the elongate barrel;

inserting the open end of barrel into the open end of the cap to align the first longitudinal axis with the second longitudinal axis; and moving the position structure to engage the first locator wherein the providing a cap includes providing a cap having a through hole spaced a distance from the open end of the cap.

10. The method of assembling the retractable ink pen of claim 9 wherein the inserting the cartridge into one of the cap and the elongate barrel includes inserting the exposed ink opening to a location configured to provide atmosphere through the through hole of the cap.

11. The method of assembling the retractable ink pen of claim 9 wherein the providing a cap includes providing a cap having a coupler disposed in the recess.

12. The method of assembling the retractable ink pen of claim 11 wherein the inserting the cartridge into one of the cap and the elongate barrel includes inserting the cartridge into the coupler of the cap.

13. The method of assembling the retractable ink pen of claim 11 wherein one of the inserting the open end of the barrel and moving the position structure to engage the first locator includes inserting the cartridge into the coupler of the cap.

14. The method of assembling the retractable ink pen of claim 9 wherein the moving the position structure into engagement with the first locator completes the assembly of the retractable ink pen.

15. A retractable ink pen including an elongate ink cartridge having writing end and an exposed ink opening, wherein the writing end moves from a retracted position to an extended position for writing, the retractable ink pen comprising:

a cap defining a first longitudinal axis, the cap including a recess having an inner surface including one of: i) a positioning ring, and ii) both a first groove and a second groove spaced a distance from the first groove along a first longitudinal axis of the cap;

an elongate barrel defining a second longitudinal axis aligned with the first longitudinal axis, the elongate barrel including an outer surface having the other of the ring and both the first groove and the second groove, wherein the positioning ring is located at the first groove when the writing end is in the retracted position and wherein the positioning ring is located at the second groove when the writing end is in the extended position.

16. The retractable ink pen of claim 15 wherein the first groove is located between a first ring and a second ring, and the second groove is located between a third ring and a fourth ring.

17. The retractable ink pen of claim 16 wherein the cap includes coupler disposed in the recess, the coupler being configured to fix the location of the cartridge with respect to the cap.

18. The retractable ink pen of claim 17 wherein the cap includes a through hole configured to expose the recess of the cap to atmosphere such that the exposed ink opening of the cartridge is subject to atmospheric pressure located externally to the retractable ink pen.

19. The retractable ink pen of claim 15 wherein the cap and one of i) the positioning ring and ii) both of the first groove and the second groove comprises a single unitary part.

20. The retractable ink pen of claim 19 wherein the barrel and one of i) the positioning ring and ii) both of the first groove and the second groove comprises a single unitary part.

21. The retractable ink pen of claim 15 wherein the retractable ink pen lacks a spring to assist the ink cartridge from moving between the extended position to the retracted position.

* * * * *